US005339579A

United States Patent [19]

Woodyer et al.

[11] Patent Number: 5,339,579

[45] Date of Patent: Aug. 23, 1994

[54] SECURITY WELL COVERS

[76] Inventors: Bruce O. Woodyer; Kimberly A. Woodyer, both of 1209 Spring Creek Rd., Elgin, Ill. 60120

[21] Appl. No.: 42,546

[22] Filed: Apr. 5, 1993

Related U.S. Application Data

[63] Continuation-in-part of Ser. No. 954,270, Sep. 30, 1992, Continuation-in-part of Ser. No. 954,270, Sep. 30, 1992.

[51] Int. Cl.[5] ..... E04F 17/06; E04C 2/38

[52] U.S. Cl. ..... 52/107; 52/815; 52/816; 52/822; 29/897.32; 292/162; D25/54

[58] Field of Search ..... 52/107, 815, 817, 822, 52/201, 200, 656.2, 656.3, 656.7, 816, 818, 819, 820; 160/369; 292/162, 156, 157; 29/897, 897.3, 897.32; 228/173.4; D25/54

[56] References Cited

U.S. PATENT DOCUMENTS

| | | | |
|---|---|---|---|
| D. 262,492 | 12/1981 | Kearnes | D25/54 |
| D. 265,591 | 7/1982 | Mackes | D25/54 |
| 1,840,397 | 1/1932 | Keyes | 52/107 |
| 2,237,564 | 4/1941 | Keyes | 52/107 |
| 3,048,900 | 8/1962 | Slade | 52/107 |
| 3,703,791 | 11/1972 | Slade | 52/107 |
| 4,127,156 | 11/1978 | Brandy | 160/369 |
| 4,771,574 | 9/1988 | Stephens | 292/162 |
| 4,877,275 | 10/1989 | DeForrest, Sr. | 292/162 |
| 4,896,467 | 1/1990 | McGinnis | 52/107 |
| 4,903,455 | 2/1990 | Veazey | 52/822 |

FOREIGN PATENT DOCUMENTS

| | | | |
|---|---|---|---|
| 2913112 | 10/1980 | Fed. Rep. of Germany | 52/107 |

*Primary Examiner*—Michael Safavi
*Attorney, Agent, or Firm*—Charles F. Meroni, Jr.

[57] ABSTRACT

A security well cover to be mounted on a window well. The window well has an upright arcuate wall with a semi-circular window well bead. The security well cover has a five-sided angular flange structure with five upright sides all having a common cover radius slightly larger than a window well radius for seated engagement on top of a semi-circular window well bead. An elongated rear closure plate is joined at opposite ends of the closure plate to opposite ends of the five-sided angular flange structure or suitable welds. A piece of wire mesh is sized to act as a closure for the security well cover. Outer margins of the mesh are attached to the five-sided angular flange structure and to the elongated rear closure plate in unitary assembly therewith. The security well cover is sized to rest on top of a semi-circular window well. Manually disengageable latchable brackets are secured to an underside of the cover and are accessible only from an underside of the window well cover. The brackets are provided for securing the window well cover at radially spaced intervals in locked assembly with a semi-circular window well bead.

29 Claims, 4 Drawing Sheets

SECURITY WELL COVERS

This is a continuation-in-part of copending application Ser. No. 07/954,270, filed on Sep. 30, 1992.

FIELD OF THE INVENTION

My invention is particularly related to a new and improved security well cover for mounted disposition upon a top open side of a window well and more particularly to a new and improved security latch system for attaching the cover to the window well from beneath the window well cover to prevent an intruder from being able to disengage the security latch after being secured between the window well and the cover.

Heretofore various embodiments of a window well cover have been proposed and attention is directed to the following patents:

| Inventor's Name | Title of Patent | U.S. Pat. No. |
|---|---|---|
| R. M. Veazey | Panel For A Window Well Cover And The Like | 4,903,455 |
| D. McGinnis | Window Well Cover | 4,896,467 |
| H. J. Slade | Window Well Cover | 3,703,791 |
| T. L. Kearnes | Window Well Cover | Des. 265,591 |
| R. C. Mackes | Window Well Cover | Des. 262,492 |

The patentee uses synthetic plastic type window well covers as indicated at 20 in U.S. Pat. No. 3,703,791. The patentee here discloses the use of clips 32 which co-act with a bead to hold the cover in place but it does not appear that any security latch system is disclosed to insure that an intruder can be prevented from easily gaining access to the interior of the window well.

U.S. Pat. No. 4,896,467 concerns itself with a one piece plastic window well cover 10 which is shaped and constructed so that it can be supported at its outer margin by having a rolled upper edge 18 providing a semi-circular lift for engagement with a rolled edge 20 of the cover 18. The cover is stated to be molded out of polyethylene plastic and is constructed so as to act as a planter for receiving flowers and the like. The Patentee does not discuss the use uf any security latch system.

U.S. Pat. No. 4,903,455 concerns itself with a window well cover 10 which is of a parallel sided shape as shown in FIG. 1. The Patentee describes this cover as being "a unique panel for waterproofing structural openings, such as a window well, for such insulation as a lean-to for mounting against the side of a building, and similar applications which can be quickly installed*". The Patentee does disclose the idea of providing an inside latch (not shown) to secure the panel 10** in its down position (or window sealing) position which inside latch can be unlatched to enable the panel to be easily rotated upwardly for emergency egress. (See column 5, lines 62–67.) The Patentee does not disclose the latch nor does the Patentee disclose the unique improved construction of our latch.

As will be described in greater detail hereinafter, the security window well cover differs from those previously proposed covers by being provided with a unique and improved construction and so secured to the cover that though access to the cover cannot be gained except from inside the building after a window such as a basement window has been moved into an open position so that a person can then operate the security latches from the interior of a window well beneath the window well cover.

SUMMARY OF THE INVENTION

According to features of our invention, we have provided a new and improved combination which includes a security well cover structure or cover to be mounted on a window well having an upright arcuate wall with a semi-circular window well bead, the improved security well cover structure has a five-sided angular flange structure with five upright sides all having a common cover radius slightly larger than a window well radius for seated engagement on top of a semi-circular window well bead, an elongated rear closure plate, means joins opposite ends of the closure plate to opposite ends of the five-sided angular flange structure, a piece of wire mesh is sized to act as a closure for the security well cover, means attaches outer margins of the mesh to the five-sided angular flange structure and to the elongated rear closure plate in unitary assembly therewith, the security well cover being sized to rest on top of a semi-circular window well, and manually disengageable latchable bracket means accessible only from an underside of the window well cover is provided for securing the window well cover at radially spaced intervals in locked assembly together with a semi-circular well bead.

Other features of our invention relate to the manually disengageable bracket means including a channel-shaped bracket structure defining a channel for nested engagement about an outside radius of the bead, the channel-shaped bracket structure having an elongated bracket leg for underlying the security well cover structure, an L-shaped angular bracket having a downwardly extending bracket leg for engaging an inside radius of a window well bead for holding a window well bead in the bracket channel, and removable fastener means connects another leg of the L-shaped bracket to the elongated bracket leg in locked assembly together, a vertical post extends downwardly beneath a security well cover structure for attachment in integral assembly thereto, the elongated bracket leg having a hole, post being telescopingly engageable from an under side of the security well cover structure through the hole, and a removable pin fastener is provided for locking the post to the elongated bracket leg for providing another point of locked engagement with the elongated bracket leg to further secure the security well structure in security locked assembly with an upright arcuate window well wall.

Further features of our invention relate to metallic protective security cover plates being disposed on an under side of the well cover structure, means attaches said protective security plates to the angular flange structure, each of the posts being attached at one end to an associated one of the protective security cover plates, the protective security cover plates being disposed in protective overlying relation to the latching bracket means as a security against manipulation of the latch from a position outside of the cover structure and a window well when mounted thereon.

Yet other features of our invention concern a window well cover structure mounted on the window well, the window well including an upright arcuate wall having a window well radius, the upright arcuate wall having a semi-circular bead, the window well cover structure including a cover, the cover having a five-sided angular flange structure with five upright sides all having a common cover radius slightly larger than the window well radius for seated engagement on top of the semi-circular window well bead, an elongated rear closure plate, means joins opposite ends of the elongated rear closure plate to opposite ends of the five-sided angular flange structure, a piece of wire mesh is sized to act as a closure for said security well cover, means attaches outer margins of the mesh to the five-sided angular flange structure and to the elongated rear closure plate in unitary assembly therewith, the security well cover being sized to rest on top of the bead on the window well, and manually disengageable latchable bracket means secured to an underside accessible only from an underside of the window well cover securing the window well cover at radially spaced intervals to the bead on the security well in locked assembly together.

Yet other features of our invention relate to the method of manufacture of a window well cover comprising the steps of forming a series of rim angles, bias cutting ends of the rim angles so that they can be butt engaged to form a five-sided semi-hexagonal rim, welding the bias cut ends of the rim angles in fixed assembly, forming a sixth elongated angular rim angle and welding its opposite ends on top of underlying ones of the rim angles, cutting a piece of wire mesh having a peripheral configuration approximating the semi-hexagonal shape of the rim angles, and welding the mesh to legs of the rim angles on an underside thereof.

DESCRIPTION OF THE PREFERRED EMBODIMENT

Figure 1:
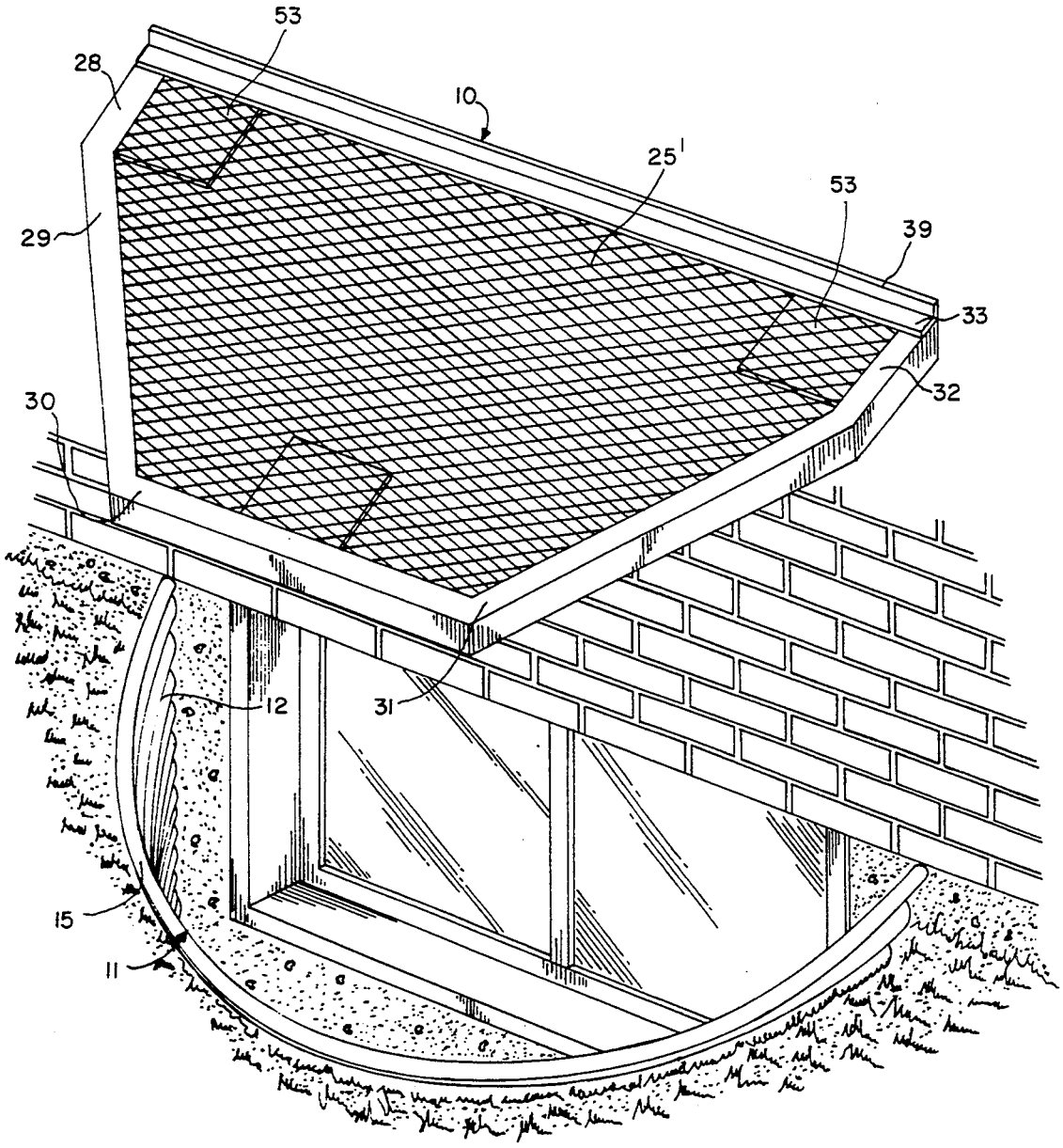
FIG. 1 is a perspective view of a window well and security window well cover structure overlying the window well in readiness to be lowered onto the window well.
Figure 2:
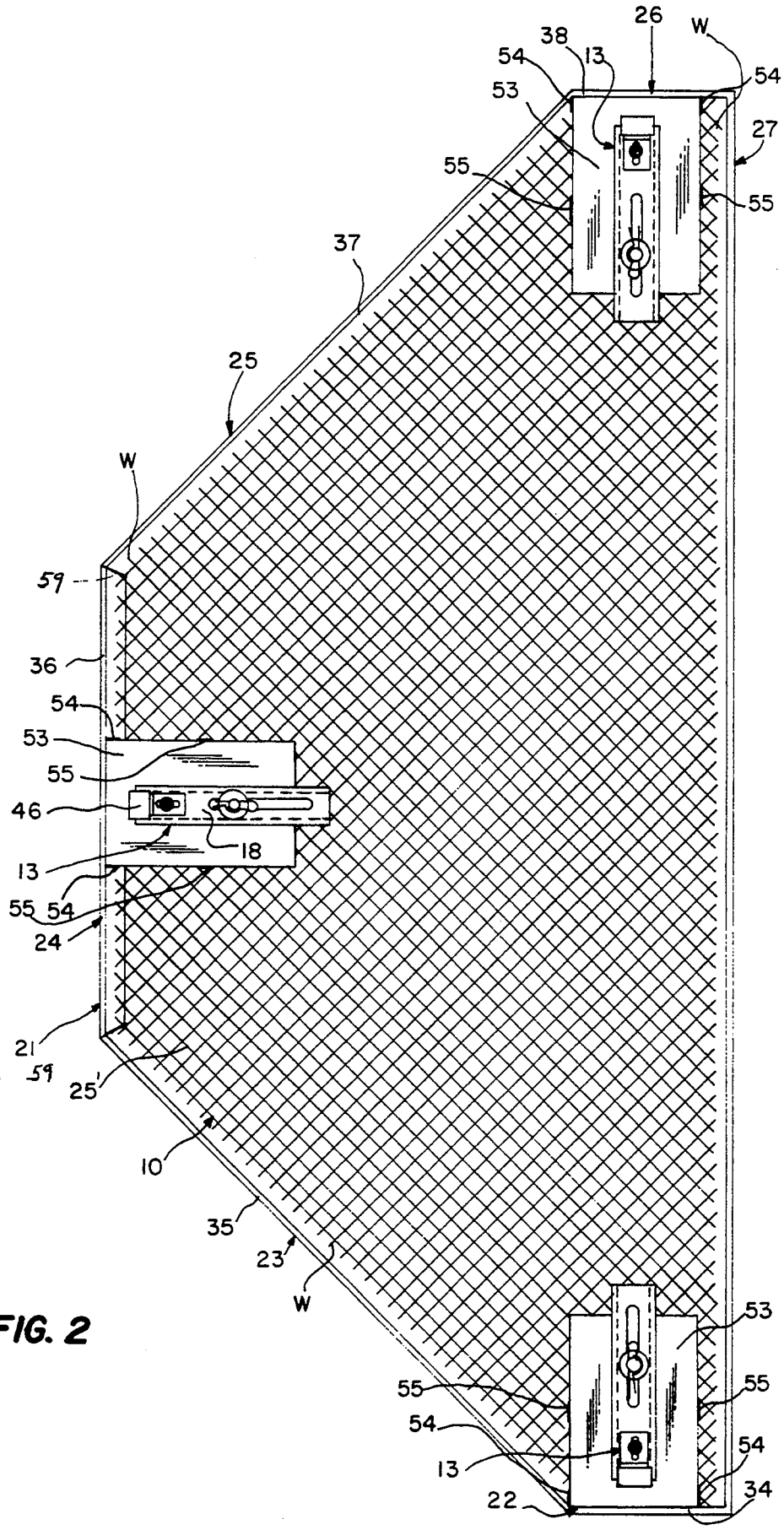
FIG. 2 is a bottom plan view of our security well cover structure embodying important features of our invention.
Figure 3:
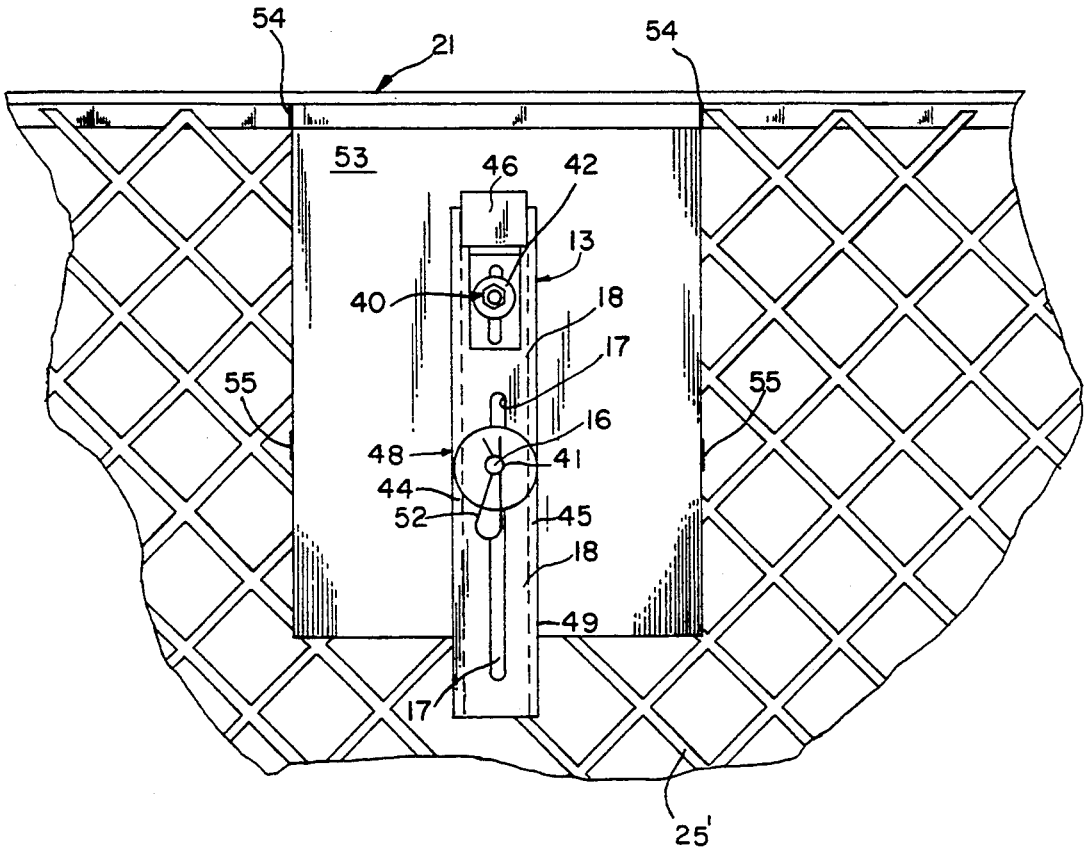
FIG. 3 is an enlarged fragmentary bottom view of our latching device or security latch for securing the window well structure in locked assembly with the window well.
Figure 4:
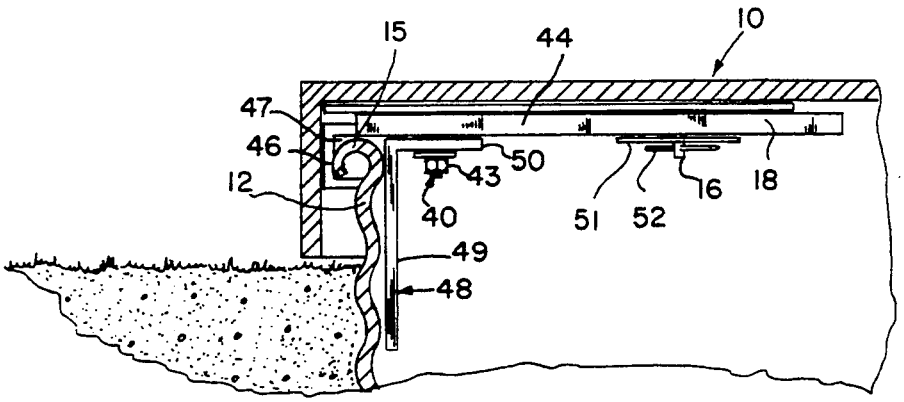
FIG. 4 is an enlarged vertical section through a window well and our new security well cover structure showing other features of our invention with the cover structure being in locked assembly with the window well.

According to important features of our invention, we have provided a new and improved window well cover structure which includes a security or window well cover 10 as seen in FIG. 1. The cover is adapted to be mounted upon a metallic window well 11 having an arcuate or semi-circular shape. The window well cover 10 herein disclosed is of an unhinged lift on, lift off type. There are no hinges between the cover 10 and an upright wall 12 of the window well 11. We have provided a security system comprising a group of manually operable latch assemblies or latches 13 for the window well cover 10. This system includes the three independently manually operable latches 13 (FIGS. 2 and 3) which co-act with an arcuate bead 15 on the vertical wall 12 of the window well 11 as seen in FIGS. 3 and 4. The latch 13 is slidable in a generally radial direction so that it can be moved back and forth into various adjustable latched and unlatched positions with the bead 15. The full line illustration of the latch shown in FIGS. 3 and 4 illustrate the latched position of the manually operable latch 13. The dotted line position of components of the latch 13 show how a latch post 16 is disengaged from an elongated hole 17 in an elongated latch bracket 18. A key 52 is engageable in one of a series of post key holes 56 in the post 16 to secure the cover to the elongated latch bracket 18.

The cover 10 is of a truncated polygonal shape or a semi-hexagonal shape and has two sets of parallel sides or rim flanges as will be discussed in further detail hereafter.

The cover 10 is peripherally bounded by a six-sided annular, angular two-flanged rim structure 21. The rim structure includes rim angles 22, 23, 24, 25, 26 and 27 (FIG. 2). The rim angles each have a horitzontal leg 28, 29, 30, 31, 32, 33 and a vertical leg 34, 35, 36, 37, 38, 39 (FIGS. 1 and 2. 22,23, and 24. This rim structure 21 is comprised of heavy duty angle iron which has sufficient toughness so that it cannot be easily bent out of shape by a prybar should an intruder attempt to remove the cover 10 after it has been latched to the window well 11. The heavy duty rim structure also serves to screen or hide the latches 13 to make it more difficult to determine how the cover is secured in place on the window well 11 and its bead 15.

The cover is also provided with a piece of steel mesh 25' which has its outer edge underlapped beneath the upper annular multiflanged rim flange structure 24 to which it is welded in assembly.

The piece of steel mesh 25' is secured in welded assembly at points such as W (FIG. 2) to the underside of the angular rim structure 24 so that the cover constitutes a one piece unit with the three distinct latch assemblies 12 attached in welded assembly to the angular rim structure 24, and to the piece of steel mesh 25'.

Each cover plate 53 has the post 16 welded to its underside in a position centered on the plate 53 so as to be hidden when the plate 18 is viewed from a top side location to thwart would be thieves from learning the nature of the lock used to secure the window well cover 10 to the window well 11 to resist tampering with the lock.

Figure 5:
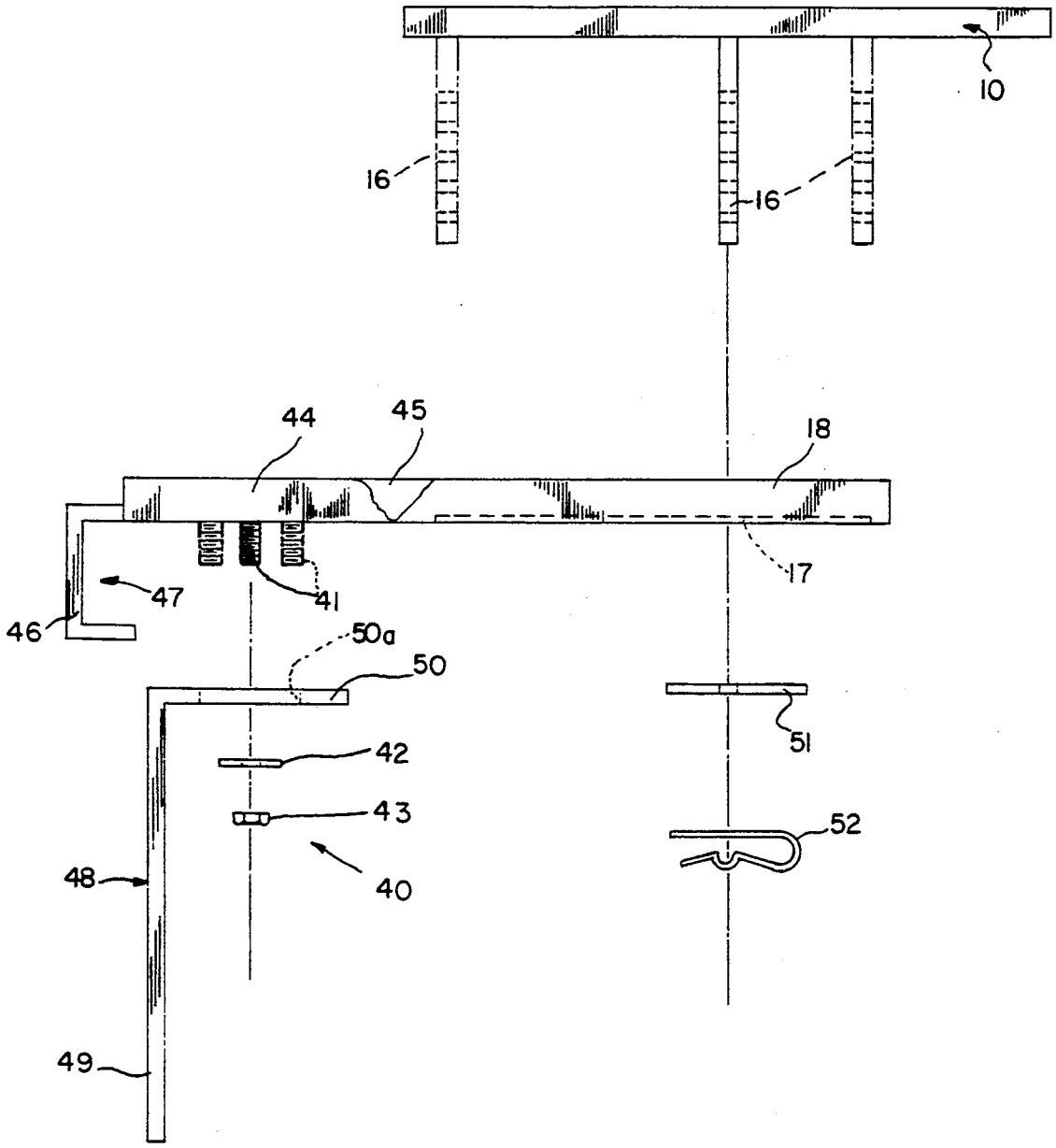
FIG. 5 is an exploded view showing the manner in which components of our latching structure interact together with certain parts shown in full and dotted lines for illustrating the adjustability of these parts to be assembled together.

The post 16 is movable laterally in the elongated slot 17 when the elongated slot is engaged on an underside of the cover plate 53 and moved transversely across the plate when the bracket 18 is being adjusted for attachment to the window well bead 15 as further shown in FIG. 4. In FIG. 5, the dotted portions of the post 16 show how the bracket 44 can be moved relative to the post 16 to dispose the post 16 in various adjusted positions in the slot 17.

In order to secure the cover 10 to the window well 11, I have provided a bead fastener 40 on the elogated latch bracket 18. To this end, the bead fastener 40 includes a fixed threaded bolt 41 which is fixedly attached to the elongated latch bracket 18. The bolt 41 has a head (not shown) which is welded to the elongated latch bracket 18. As shown in FIG. 5, the fixed threaded bolt 41 is shown in full and dotted lines illustrating the position of the bolt 41 depending on the position of the elongated latch bracket 18 on the post 16. By elongating the slot 17, the elongated latch plate can be moved longitudinally to enable the arcuate bead 15 on the window well to enter a U-shaped or channel shaped flange 46 which defines a bead slot 47. When the bead is engaged in the bead slot 47 it will be in the position shown in FIG. 4.

Mounted upon the elongated latch bracket 18 is an L-shape bracket 48 which extends downwardly from an underside of the window well cover 10 when the elongated latch bracket 18 is secured to the underside of the cover structure utilizing the post secured to the latch plate and the fastener 40 all of which co-act to secure the elongated latch bracket 18 in integral assembly to the cover structure 10. The L-shaped bracket 48 includes bracket legs 49 and 50. It is bracket leg 49 which is positioned radially inwardly, and is adapted to contact the bead 15 when the bead 15 is in the slot 47. The fastener 40 including the nut 43 serve to attach the L-shaped bracket 48 to the elongated latch bracket 18.

In order to secure the L-shaped bracket 48 to the elongated latch bracket 18, the L-shaped bracket 48 is aligned with the fixed threaded bolt 41. Since the leg 50 of the L-shaped bracket has an elongated slot 58, it can be easily aligned and the dotted line positions of the fixed threaded bolt 41 show how the elongated latch bolt 18 can be moved in the slot or into various positions as may be required until the leg 49 of the L-shape bracket 48 is butt engaged against a radially inner side of the bead 15 on the window well. At this point in time, the bead is then secured in the pocket 47 defined by the elongated latch bracket 18. Now, the threaded nut 18 is secured over the washer 42 in the manner shown in FIGS. 4 and 5 to draw the L-shaped bracket snuggly against the elongated latch bracket 18 in integral fixed assembly therewith thereby locking the cover structure to the bead 15 of the window well 11.

Referring now to the manner of securing the elongated latch bracket 18 to the cover structure 10, it will be seen that a washer 51 and a key pin 52 are provided as shown in FIG. 5. This post 16 then extends through the elongated slot 17 in the elongated latch bracket 18 whereupon the washer is moved in to position on the post 16. At this juncture, the key pin 52 can be engaged within one of the transverse holes 56 in the posts 16. The posts 16 are shown in full and dotted lines in FIG. 5 so that it can be understood how the elongated latch bracket 18 can be moved relative to the cover structure 10 and the post 16 or visa versa to assist in proper adjustment of the pocket 17 with relation to the bead 15 on the window well 11. Once the latch key 52 is in place, the elongated latch bracket 18 is then secured in fixed assembly also with the cover structure 10.

In the assembly of the cover structure on the window well, it will be appreciated that the bracket 48 is initially positioned inside the window well and engaged against a radially inner face of the bead 15. Then, the elongated latch bracket 18, and more particularly its turned under U-shaped flange 46 are positioned on the radially outer side of the bead 15. Then, the nut and bolt assembly 40 is relied upon to secure the L-shaped bracket 48 and the U-shaped flange 46 in engaged relationship on radially inner and outer sides of the bead 15. Then, the post 16 which is integral with the cover 10 is brought into engagement with the groove 17 in the elongated latch bracket 18. This post is then secured in integral relationship by placing the washer over the post and affixing the key pin 52 in a selected one of the post holes 56. The components can be disassembled by reversing the assembly procedure as just discussed, and by initially removing the key pin 52.

To ensure that the cover structure can resist being removed from the exterior of the window well or from a top side of the cover structure, we have provided a reinforced latch plate 53 on an underside of the cover 10. This latch plate 53 is welded to the rim flange structure 21 by means of welds 54. In addition, the latch plate 53 is also welded by welds 55 to the mesh all as are indicated in the drawings. Excellent results can be obtained where at least three elongated latch brackets 18 are secured to the bead 15 and also to three posts provided on an underside of three latch plates ninety degrees apart or circumferentially spaced radially inwardly of the bead 15. These posts 16 are all welded to the latch pin and are roughly one and one-half inches long, and have a quarter inch diameter.

Each latch assembly has a parallel edged latch plate 53 mounted on top of the steel mesh 25' and with its four sides, edges or margins lapped over edges of the mesh and secured in welded assembly together. An underside of the plate 53 at the area of the four plate margins is welded at 53. In addition, the plate 53 is also welded to the mesh as indicated We have also developed a new method of manufacturing a window well cover. This method contemplates forming the rim structure 24 of a series of rim angles or angular bars 22–25, 26 and 27 which each comprise one side of the multi-sided cover 10. The angular rim members or rim angles are welded at the points where they are abutted together. Then the rear rim plate or rim angle 27 which extends across the diameter of the window well cover structure 10 is butt engaged and welded to the rim angles 22 and 26. This rear rim angle 27 is L-shaped in configuration and is shown in FIG. 1 as well as elsewhere in the drawings attached. This long angle 27 is also welded to a top side of the rim flanges 28 and 32 as also shown in FIG. 1.

After the rim structure has been formed as a one piece unit, we then contemplate cutting a piece of mesh 25'. The mesh 25' is then positioned so that it underlaps the flanges of the rim structure and is welded in integral assembly thereto as previously described. Thereafter, the plates 53 are welded to the mesh and the pins or posts 16 are either secured to the latch plates 53 before or after the plates are welded to the mesh and to the underside of the rim structure. As stated before, the weld of the rim to the plate 53 is shown at 54 and the weld to secure the plate to the mesh is shown at 55. As stated, it is believed that we have also developed a new method of manufacturing a window well cover structure as just defined. The latch assembly can be then attached. It is noteworthy to observe that the latch bracket 18 has upturned side edges or flanges which serve to act as runners for the elongated latch bracket and serve to hold the bracket and more particularly its slot 17 spaced in underlying relation relative to the latch plate 53. Still further, one end of the elongated latch bracket 18 in turned under to provide the U-shaped flange 46 for engaging with the bead from the radially outer side of the bead when the elongated latch bracket 18 is secured to the window well bead 15. This unique reinforced construction also provides us with a rugged latch assembly that can readily be secured to the cover structure from an underside of the cover structure 10 when a window is open so that a householder can climb into the window well and engage the elongated latch brackets 18 in fixed assembly with the post 16 by means of the key pins 52 as previously described.

Before concluding, it should be understood that our unique window well cover structure and bracket or latch assembly has been built in such a way to make it very difficult for an intruder to remove the cover structure once it has been secured in place. The latch plates 53 also provide sturdy protection for the elongated latch brackets 18 to make it difficult for a person from an outside position relative to the window well cover structure when mounted on a window well to know how to remove the latches since the latch plates shield and hide the elongated latch brackets 18.

In the method of manufacturing the rim structure 25, the rim angles are bias cut as indicated at 59—59 in FIG. 2. These lines show the bias cut are illustrated diagrammatically for the cover 10 is otherwise illustrated in a finished state where it has been painted and the weld lines do not appear in other locations.

As described above, the security well cover 10 of the present invention provides a number of advantages, some of which have been described above and others of which are inherent in the invention. Also, modifications can be proposed to the security well cover 10 without departing from the teachings herein. Accordingly, the scope of the invention is only to be limited as necessitated by the accompanying claims.

We claim:

1. In combination, a window well cover structure mounted on a window well, the window well including an upright arcuate wall having a window well radius, the upright arcuate wall having a semi-circular bead, the window well cover structure including a cover, the cover having a five-sided angular flange structure with five upright sides all having a common cover radius slightly larger than the window well radius for seated engagement on top of said semi-circular window well bead, an elongated rear closure plate, means joining opposite ends of the elongated rear closure plate to opposite ends of said five-sided angular flange structure, a piece of wire mesh sized to act as a closure for said security well cover, means attaching outer margins of said mesh to said five-sided angular flange structure and to said elongated rear closure plate in unitary assembly therewith, the security well cover being sized to rest on top of the bead on the window well, and manually disengageable latchable bracket means secured to an underside accessible only from an underside of the window well cover securing the window well cover at circumferentially spaced intervals to the bead on the window well in locked assembly together.

2. The combination of claim 1 wherein the manually disengageable bracket means includes a channel-shaped bracket structure defining a channel for nested engagement about an outside radius of said bead, the channel-shaped bracket structure having an elongated radially extending bracket leg for underlying said security well cover structure, an L-shaped angular bracket having a downwardly extending leg for engaging an inside radius of said bead for holding the bead in the bracket channel, removable fastener means connecting another leg of the L-shaped bracket to said elongated bracket leg in locked assembly together, a vertical post extending downwardly beneath the security well cover structure and being attached in integral assembly thereto, the elongated bracket leg having a hole, said post being telescopingly engageable from an under side of the security well cover structure through the hole, and a removable pin fastener for locking the post to the elongated bracket leg for providing another point of locked engagement with said elongated bracket leg to further secure the security well structure in security locked assembly with the upright arcuate window well wall.

3. The combination of claim 1 wherein metallic protective security cover plates are disposed on an underside of the well cover structure, means attaching said protective security plates to said angular flange structure, each of said posts being attached at one end to an associated one of said protective security cover plates, said protective security cover plates being disposed in protective overlying relation to said latching bracket means as a security against manipulation of the latch from a position outside of the cover structure and window well.

4. The combination of claim 1 wherein the bracket means has relatively movable bracket parts for grasping the bead therebetween, the bracket means further including an adjustable fastener securing the relatively movable bracket parts in locked assembly with the bead on said upright arcuate wall of the window well.

5. The combination of claim 4 wherein the multi-sided angular flange is sized and positioned to protectively shield the manually disengageable latchable bracket means from tampering from an exterior of the window well and the security well cover structure mounted thereon.

6. The combination of claim 1 wherein the -five sided angular flange has each side defined by an angular rim part, and means securing the rim parts in side-by-side relation.

7. The combination of claim 6 wherein said means securing the rim parts side-by-side relation comprising a series of angularly spaced welds.

8. In combination, a window well having a window well radius, a security well cover structure mounted on said window well, the window well including an upright arcuate wall, the upright arcuate wall having a bead at its upper end, the security well cover structure having a multi-sided angular flange structure with upright sides all having a common cover radius slightly larger than the window well radius for seated engagement on top of said bead, an elongated closure plate, means joining opposite ends of the closure plate to opposite ends of said multi-sided angular flange structure, a piece of wire mesh sized to act as a closure for said security well cover, means attaching outer margins of said mesh to said multi-sided angular flange structure and to said elongated rear closure plate in unitary assembly therewith, the securing well cover being sized to rest on top of the bead on the window well, and manually disengaged latchable bracket means secured to an underside of said security well cover structure accessible only from an inside of the window well securing the window well at circumferentially spaced intervals to the security well cover structure in locked assembly together.

9. The combination of claim 8 wherein the bracket means having relatively movable bracket parts for grasping the bead therebetween, the bracket means further including an adjustable fastener securing the relatively movable bracket parts in locked assembly with the bead on said upright arcuate wall of the window well.

10. The combination of claim 9 wherein the multi-sided angular flange is sized and positioned to protectively shield the manually disengageable latchable bracket means from tampering from an exterior of the window well and the security well cover structure.

11. The combination of claim 8 wherein the multi-sided angular flange has each side defined by an angular rim part, and weld means securing the rim pans in side-by-side relation.

12. In a security well cover structure to be mounted on a window well having an upright arcuate wall with a semi-circular window well bead, the improvement of the security well cover structure having a five-sided angular flange structure with five upright sides, an elongated rear closure plate, means joining opposite ends of the closure plate to opposite ends of said five-sided angular flange structure, a piece of wire mesh sized to act as a closure for said security well cover, means attaching outer margins of said mesh to said five-sided angular flange structure and to said elongated rear closure plate in unitary assembly therewith, the security well cover being sized to rest on top of a generally semi-circular window well, and manually disengageable latchable bracket means accessible only from an underside of the window well cover when placed over a window well for securing the window well cover at circumferentially spaced intervals in locked assembly together with a generally arcuate window well bead.

13. The security well cover structure of claim 12 wherein the manually disengageable latchable bracket means includes a channel-shaped bracket structure defining a channel for nested engagement about an outside radius of said bead, the channel-shaped bracket structure having an elongated bracket leg for underlying said security well cover structure, an L-shaped angular bracket having a downwardly extending bracket leg for engaging an inside radius of a window well bead for holding a window well bead in the bracket channel, and removable fastener means connecting another leg of the L-shaped bracket to said elongated bracket leg in locked assembly together, a vertical post extending downwardly beneath a security well cover structure for attachment in integral assembly thereto, the elongated bracket leg having a hole, said post being telescopingly engageable from an under side of the security well cover structure through the hole, and a removable pin fastener for locking the post to the elongated bracket leg for providing another point of locked engagement with said elongated bracket leg to further secure the security well structure in security locked assembly with an upright arcuate window well wall.

14. The security well cover structure of claim 12 wherein metallic protective security cover plates are disposed on an under side of the well cover structure, means attaching said protective security plates to said angular flange structure, each of said posts being attached at one end to an associated one of said protective security cover plates, said protective security cover plates being disposed in protective overlying relation to said latching bracket means as a security against manipulation of the latch from a position outside of the cover structure and a window well when mounted thereon.

15. A security well cover structure to be mounted on a window well having an upright arcuate wall with a semi-circular window well bead, the improvement of the well cover having a multi-sided angular flange structure with five upright sides all having a common cover radius, an elongated rear closure plate structure, means joining opposite ends of the closure plate structure to opposite ends of said multi-sided angular flange structure, a piece of wire mesh sized to act as a closure for said security well cover, means attaching outer margins of said mesh to said five-sided angular flange structure and to said elongated rear closure plate in unitary assembly therewith, the security well cover being sized to rest on top of a semi-circular window well, and manually disengageable latchable bracket means secured to one side of said security well cover structure to be accessible only from an underside of the window well cover for securing the window well cover at circumferentially spaced intervals in locked assembly together with a semi-circular well bead.

16. The cover structure of claim 15 wherein said closure plate structure is angular in configuration and has an upright leg extending upwardly above the well cover for rear abutment against a side wall of a building above a semi-circular window well bead when mounted thereon.

17. The cover structure of claim 15 wherein metallic protective security cover plates are disposed on an underside of the well cover structure, means attaching said protective security plates to said multi-sided angular flange structure, said protective security cover plates being disposed in protective overlying relation to said latchable bracket means as a security against manipulation of the latchable bracket means from a position outside of the cover structure and window well.

18. The cover structure of claim 15 in the bracket means has relatively movable bracket parts for retaining attachment to a window well bead, the bracket means further including an adjustable fastener securing the relatively movable bracket parts in locked assembly with a window well bead.

19. The cover structure of claim 15 wherein the multi-sided angular flange structure is sized and positioned to protectively shield the manually disengageable latchable bracket means from tampering from an exterior of a window well and the security well cover structure when mounted on a window well bead.

20. In an angulated security well cover structure to be mounted on a window well having an upright arcuate wall with a semi-circular window well bead, the improvement of a six-sided security well cover having a five-sided angular flange structure, the five-sided angular flange structure providing five upright sides all having a common cover radius, an elongated rear closure plate comprising a sixth side of the six-sided security well cover, means joining opposite ends of the closure plate to opposite ends of said five-sided angular flange structure, a piece of wire mesh sized to act as a closure for said security well cover, means attaching outer margins of said mesh to said five-sided angular flange structure and to said elongated rear closure plate in unitary assembly therewith.

21. The security well cover structure of claim 20 further including a manually disengageable latchable bracket means accessible only from an underside of the window well cover when placed over a window well for securing the window well cover at circumferentially spaced intervals in locked assembly together with a generally arcuate window well bead.

22. The security well cover structure of claim 21 wherein metallic protective security cover plates are disposed on an under side of the well cover structure, means attaching said protective security plates to said angular flange structure, said manually disengageable latchable bracket means including posts being attached at one end to an associated one of said protective security cover plates, said protective security cover plates being disposed in protective overlying relation to said latching bracket means as a security against manipulation of the latch from a position outside of the cover structure and a window well when mounted thereon.

23. The security well cover structure of claim 21 wherein the manually disengageable bracket means includes a channel-shaped bracket structure defining a channel for nested engagement about an outside radius of a window well bead, the channel-shaped bracket structure having an elongated radially extending bracket leg for underlying said security well cover structure, an L-shaped angular bracket having a downwardly extending leg for engaging an inside radius of a window well bead for holding a window well bead in the bracket channel, removable fastener means connecting another leg of the L-shaped bracket to said elongated bracket leg in locked assembly together, a vertical post extending downwardly beneath the security well cover structure and being attached in integral assembly thereto, the elongated bracket let having a hole, said post being telescopingly engageable from an under side of the security well cover structure through the hole, and a removable pin fastener for locking the post to the elongated bracket leg for providing another point of locked engagement with said elongated bracket leg to further secure the security well structure in security locked assembly with an upright arcuate window well wall.

24. The security well cover of claim 23 wherein metallic protective security cover plates are disposed on an under side of the well cover structure, means attaching said protective security plates to said angular flange structure, each of said posts being attached at one end to an associated one of said protective security cover plates, said protective security cover plates being disposed in protective overlying relation to said latching bracket means as a security against manipulation of the latch from a position outside of the cover structure and a window well.

25. The security well cover of claim 21 wherein the bracket means having relatively movable bracket parts for grasping a window well bead therebetween, the bracket means further including an adjustable fastener for securing the relatively movable bracket parts in locked assembly with a window well bead on said upright arcuate wall of a window well.

26. The security well cover of claim 21 wherein the multi-sided angular flange is sized and positioned to protectively shield the manually disengageable latchable bracket means from tampering.

27. A method of manufacture of a window well cover comprising the steps of forming a series of rim angles, bias cutting ends of the rim angles, butt engaging the ends of the rim angles to form a five-sided rim, welding the bias cut ends of the rim angles in fixed assembly, forming an elongated angular rim angle and welding its opposite ends on top of underlying ones of the rim angles, cutting a piece of wire mesh having a peripheral configuration approximating an interior shape defined by the rim angles, and welding the mesh to legs of the rim angle on an underside thereof.

28. The method of claim 27 further characterized by welding elongated steel plates to an underside of the mesh and adjacent ones of the rim angles.

29. A method of manufacture of a window well cover comprising the steps of forming a five-sided rim, forming an elongated angular rim angle and welding its opposite ends to opposite ends of the five-sided rim, cutting a piece of wire mesh having a peripheral configuration approximating an interior shape defined by the five sided rim and the elongated angular rim angle, welding the mesh to the rim angle on an underside thereof, and attaching protective security cover plates to said cover at spaced locations on the cover.

* * * * *